United States Patent [19]

Davis, Jr. et al.

[11] Patent Number: 4,537,457

[45] Date of Patent: Aug. 27, 1985

[54] CONNECTOR FOR PROVIDING ELECTRICAL CONTINUITY ACROSS A THREADED CONNECTION

[75] Inventors: Albert P. Davis, Jr.; Leon H. Robinson, both of Houston, Tex.

[73] Assignee: Exxon Production Research Co., Houston, Tex.

[21] Appl. No.: 697,689

[22] Filed: Feb. 4, 1985

Related U.S. Application Data

[63] Continuation of Ser. No. 489,639, Apr. 28, 1983, abandoned.

[51] Int. Cl.[3] ..... H01R 3/00

[52] U.S. Cl. ..... 339/117 P; 339/16 C

[58] Field of Search ..... 339/15 R–16 RC, 339/117

[56] References Cited

U.S. PATENT DOCUMENTS

| | | | |
|---|---|---|---|
| 2,096,279 | 10/1937 | Marcher | 255/28 |
| 2,178,931 | 11/1939 | Crites et al. | 339/16 R |
| 2,748,358 | 5/1956 | Johnston | 339/16 |
| 3,470,521 | 9/1969 | Downey | 339/8 |
| 3,470,524 | 9/1969 | Culver | 339/90 |
| 3,486,107 | 12/1969 | Richter et al. | 324/1 |
| 3,518,608 | 6/1970 | Papadopoulos | 339/16 |
| 3,518,609 | 6/1970 | Fontenot | 339/16 |
| 3,696,332 | 10/1972 | Dickson et al. | 340/18 LD |
| 3,753,206 | 8/1973 | Busuttil et al. | 339/16 C |
| 3,789,936 | 2/1974 | McCullough | 175/50 |
| 3,829,816 | 8/1974 | Barry et al. | 339/16 R |
| 3,976,347 | 8/1976 | Cooke et al. | 339/35 |
| 4,051,456 | 9/1977 | Heilhecker et al. | 340/18 LD |
| 4,117,287 | 9/1978 | Walker et al. | 339/16 R |
| 4,142,770 | 3/1979 | Butler et al. | 339/94 M |

OTHER PUBLICATIONS

"Downhole Measurements Through Modified Drill Pipe", E. B. Denison, ASME Paper No. 76-Pet-53, 1976.

*Primary Examiner*—Eugene F. Desmond
*Attorney, Agent, or Firm*—Richard F. Phillips

[57] ABSTRACT

A connector 10 is disclosed which is suited for use in effecting an electrical connection between separate conductor bundles 12, 16 in adjacent sections of a threadably sectioned conduit. The connector 10 is especially well suited for use in providing electrical continuity across a tool joint in a drill string. The connector 10 has first and second portions 20, 22 each adapted for placement in a corresponding connection portion of two connectable lengths of conduit. The first and second portions 20, 22 form a pin and box connection. Corresponding contacts 46, 80 on the first and second portions 20, 22 assume a conductive relationship in response to connection of the conduit. The contacts 46, 80 of each connector portion 20, 22 are radially symmetric about the axis of the conduit and are axially displaced one from the other. The contacts 46, 80 within the assembled connector 10 are isolated from the conduit environment. Apparatus is provided for maintaining a dielectric fluid in the region surrounding the contacts 46, 80 to ensure electrical insulation of the connector 10.

14 Claims, 5 Drawing Figures

CONNECTOR FOR PROVIDING ELECTRICAL CONTINUITY ACROSS A THREADED CONNECTION

CROSS REFERENCE TO RELATED APPLICATION

This application is a continuation application of U.S. patent application Ser. No. 489,639, filed Apr. 26, 1983, now abandoned.

BACKGROUND OF THE INVENTION

1. Field of the Invention

The present invention relates generally to electrical connectors. More specifically, the present invention concerns connectors for establishing electrical continuity between conductors in a first tubular element and corresponding conductors in a mating second tubular element, where said connectors are suited for use in a high pressure, conductive fluid environment.

2. Description of the Technical Problem

The search for and production of valuable subsurface fluids, such as hydrocarbons, carbon dioxide, helium and geothermally heated water, typically requires that a borehole be drilled from the surface of the earth to the strata bearing the subsurface fluid. The drilling of such boreholes is accomplished by a drill bit supported and controlled by a drilling rig located at the earth's surface. A tubular column known as the drill string connects the drill bit to the drilling rig. In rotary drilling, utilized in the majority of modern drilling operations, the drill string serves to transmit both torque and drilling fluid from the drilling rig to the drill bit. The drill string is composed of tubular elements which are detachably joined to one another at threaded connections termed tool joints.

In certain applications it is desirable to provide the drill string or bit with electrical instrumentation. Suitable instrumentation can be utilized to record the condition of the drill bit, log formation properties in the course of drilling operations, measure various borehole conditions and control electro-mechanical apparatus in the drill string or bit. In certain schemes of operation, monitoring the output of downhole instrumentation or controlling downhole apparatus from the surface requires that one or more electrical conductors extend along the drill string and across at least one of the tool joints.

The nature of tool joints presents formidible obstacles to the reliable transmission of electrical signals along a drill string incorporating an electrical conductor. Tool joints are composed of two portions, a pin and a box. The pin has exposed tapered threads which correspond to recessed tapered threads of the box. A pin is connected to one end of each element of the drill string and a box to the other end such that the various elements of the drill string can be threaded one to the other. As the borehole deepens, additional joints are threaded onto the end of the drill string to increase its length. The tool joints must be adapted to accept both axial loading, often from the weight of as much as an 8,000 meter length of drill pipe, and the significant torsional loadings imposed in the course of rotary drilling. Additionally, the tool joints are exposed to much rough usage, abrasion and shock loadings in the course of making up and breaking out the threaded connections in drilling operations.

Transmitting an electrical signal across a tool joint can be accomplished by providing mating electrical contacts at interfacing portions of the adjoining elements of the drill string. However, this use of a contact type electrical connector attached to the tool joint poses many difficulties. The use of conductive drilling fluids at high downhole pressures creates a significant insulation problems. The need for a fluid passageway with low flow resistance through the conduit presents significant size and configuration limitations on the connector. The rough handling, extreme vibrations and abrasive particulate matter to which the drill string is subjected in the course of drilling establish significant reliability obstacles. Further, rig efficiency concerns and the potential for human error render it highly desirable that the electrical connection require a minimum of special action on the part of the drilling crew in making up the tool joint.

The present invention is directed to advantageously meeting the requirements listed above.

DISCLOSURE OF THE INVENTION

In one aspect of the present invention, a connector is provided for establishing electrical continuity between at least one conductor in a first element and at least one corresponding conductor in a second element. The first and second elements are connectable in a fixed relationship one to the other as by a threaded or bayonet connection. The electrical continuity establishing apparatus includes first and second connector portions positioned, respectively, in mating portions of the first and the second connectable elements. The first and second portions of the connector are provided with contacts corresponding to each of the associated conductors. The first and second portions of the connector are configured and positioned such that in response to connection of the first and second elements one to the other, the first and second connector portions are established in mating association with corresponding ones of the contacts being brought into electrically conductive relationship. The first and second connector portions are provided with seals adapted to establish a sealed volume surrounding the contacts. This sealed volume assists in maintaining the contacts in fluid isolation from the environment to which the first and second connectable elements are exposed. Means is provided for maintaining dielectric liquid within the sealed volume. The dielectric fluid maintaining means is adapted for maintaining the dielectric fluid at substantially the same pressure to which the first and second elements are exposed while preventing the intrusion of any foreign fluid into the sealed volume. The present electrical continuity establishing apparatus is especially well suited for providing electrical continuity between first and second conductor bundles in separate, threadebly connectable elements of a drill string and bit assembly.

Prior electrical connectors adapted for use in telemetered borehole drilling applications are subject to numerous defects. Certain of these prior connectors are adapted to be positioned at the thread interface of the tool joint and, hence, are exposed to great physical stresses in drilling operations. Further, connectors positioned within this threaded region require that a nonconductive pipe dope be utilized in making up the tool joint. This is undesirable. Most prior electrical connectors for use in passing signals between adjacent elements of a drill string require that some special action be taken by the drilling crew to effect the electrical connection.

The need for such special action is disadvantageous in that it slows drilling operations and can be forgotten. Further, most prior electrical connectors adapted for drill string applications are susceptible to the intrusion of drilling fluids. This can result in an insulation failure of the electrical connector.

It is an object of the present invention to provide an electrical connector for use in drill string and bit assemblies which is not positioned within the threaded region of the tool joint. It is an additional object of this invention to provide an electrical connector for use in the drill string in which the electrical connection is established automatically upon making up the tool joint. It is a further object to provide a connector in which the contact region is sealed from borehole fluids and in which the contact region is filled with a dielectric fluid. It is yet another object of this invention to maintain the pressure of the contact region substantially equal to that of the borehole while preventing intrusion of borehole fluids into the contact region.

BRIEF DESCRIPTION OF THE DRAWINGS

For a better understanding of the present invention, reference may be had to the accompanying drawings in which.

Figure 1:
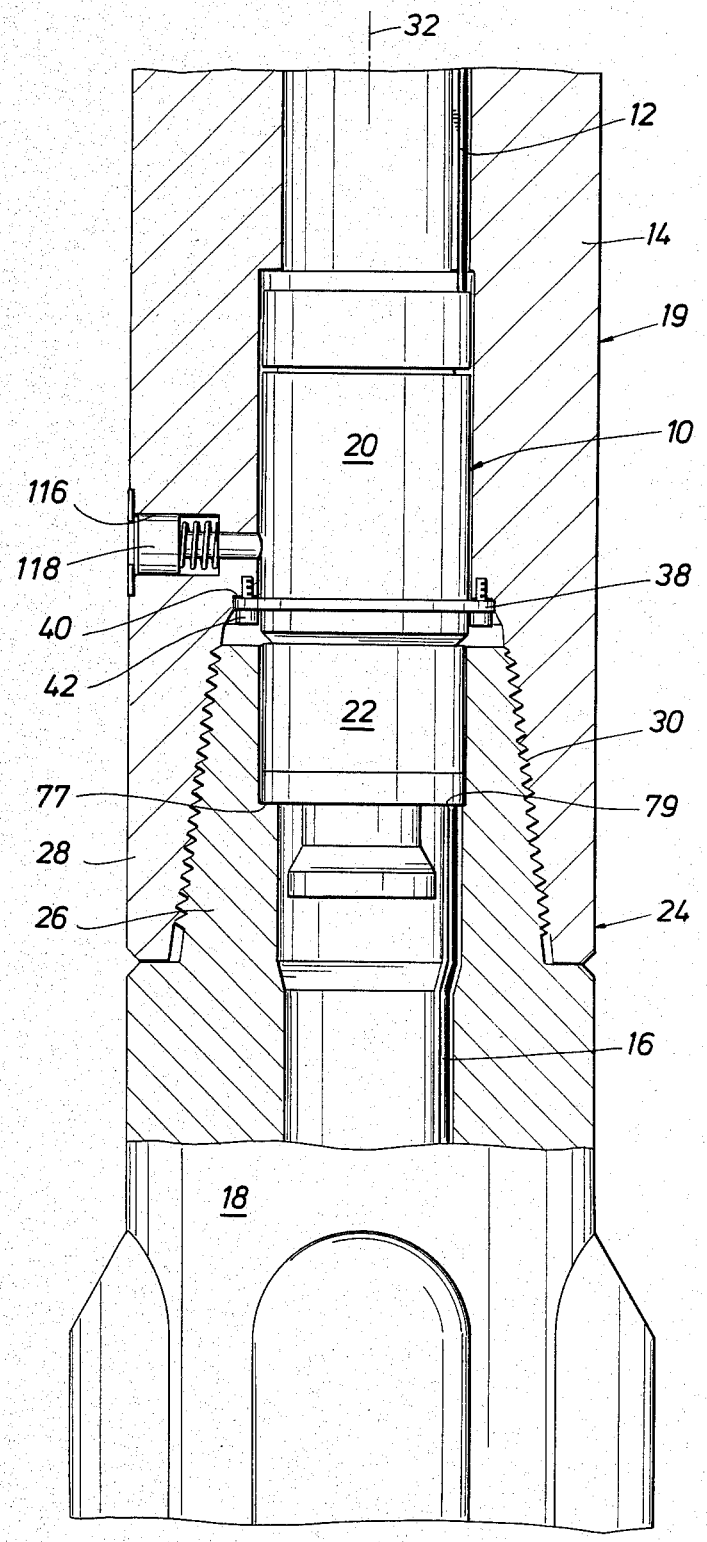
FIG. 1 shows an elevational view partially in cross section of the connector positioned within a tool joint, the tool joint being depicted in cross section and the connector and charging fitting being depicted in elevation.

It is to be understood that the drawings are not intended as a definition of the invention but are provided only for the purpose of illustrating a preferred embodiment of the invention.

BEST MODE FOR CARRYING OUT THE INVENTION

Referring more particularly to the figures, a connector for providing electrical continuity between corresponding sets of conductors across a threaded connection is generally indicated by the reference numeral 10. In the preferred embodiment, this connector 10 is adapted for use in transmitting electrical signals between threadably connected tubular elements, such as are commonly utilized in the drill strings employed in rotary drilling operations. However, it must be emphasized that the present invention is generally useful in a broad range of applications where an electrical connection must be made between two elements adapted to be physically secured one to the other.

More specifically, as best shown in FIG. 1, the connector 10 serves to provide electrical continuity between a first plurality of conductors 12 affixed within a first element 14 and a second plurality of conductors 16 affixed within a second element 18. The first and second elements 14, 18 are detachably connectable one to the other. The connector 10 has two portions, a connector first portion 20 which is mountable within the first element 14, and a connector second portion 22 which is mountable within the second element 18. The connector 10 is specifically adapted to automatically provide continuity between the two conductor bundles 12, 16 in response to the first and second elements 14, 18 being connected together in their intended fashion. The connector 10 is best suited for use in threaded and bayonet attachments and other applications in which one of the first and second elements 14, 18 has a longitudinal axis and is inserted into the other of the first and second elements 14, 18 in a direction along this axis.

In the preferred embodiment, the first and second elements 14, 18 are mating portions of a drill string and bit assembly 19. For the purposes of this description, the drill string is defined to include the drill pipe, drill collars and subs. In the embodiment depicted in FIG. 1, the first element 14 is a drill collar and the second element 18 is a rotary drill bit. Typically, the first and second elements 14, 18 are affixed one to the other by a tool joint 24. The tool joint 24 is composed of a pin 26 and a box 28 which have mating tapered threads 30. The individual elements of a drill string and bit assembly 19 typically are connected, or "made-up", with the aid of mechanical elements, such as tongs (not shown), which impose a very high torsional force between the corresponding portions of the tool joint 24 to form a tightly threaded assembly. This prevents unintended loosening of the tool joint 24 by vibrations and shock loading. The threads 30 of the tool joint 24 are generally coated with a tool joint compound to improve the fluid seal established by the made up tool joint 24 and to promote ease of disconnection of the pin 26 from the box 28 in the breaking out operation. Most tool joint compounds which are commonly utilized in the drilling industry are electrically conductive.

The connector first and second portions 20, 22 are configured and positioned to mate in conductive relationship in response to the first and second elements 14, 18 being threaded together. Accordingly, the connector first and second portions 20, 22 are substantially radially symmetric about an axis that is colinear with the longitudinal axis 32 of the tool joint 24. The first and second connector portions 20,22 form a pin and box connection which can simultaneously accommodate the rotation and axial sliding motion which occurs in making up a threaded connection. This connection is fully effected with the first and second connector portions 20, 22 properly oriented one to the other in response to the first and second elements 14, 18 being made up. No mechanical interlockage of the connector first and second portions 20, 22 is required because their relative positions are maintained by the made up tool joint 24. Consequently, as will be discussed in greater detail below, the only physical contact required between the connector first and second portions 20, 22 is that necessary to establish electrical continuity between the first and second connector bundles 12, 16 and that necessary to establish a sealed region at the interface between the two connector portions 20, 22 to isolate the exposed metal contacts from the wellbore environment.

Figure 2:
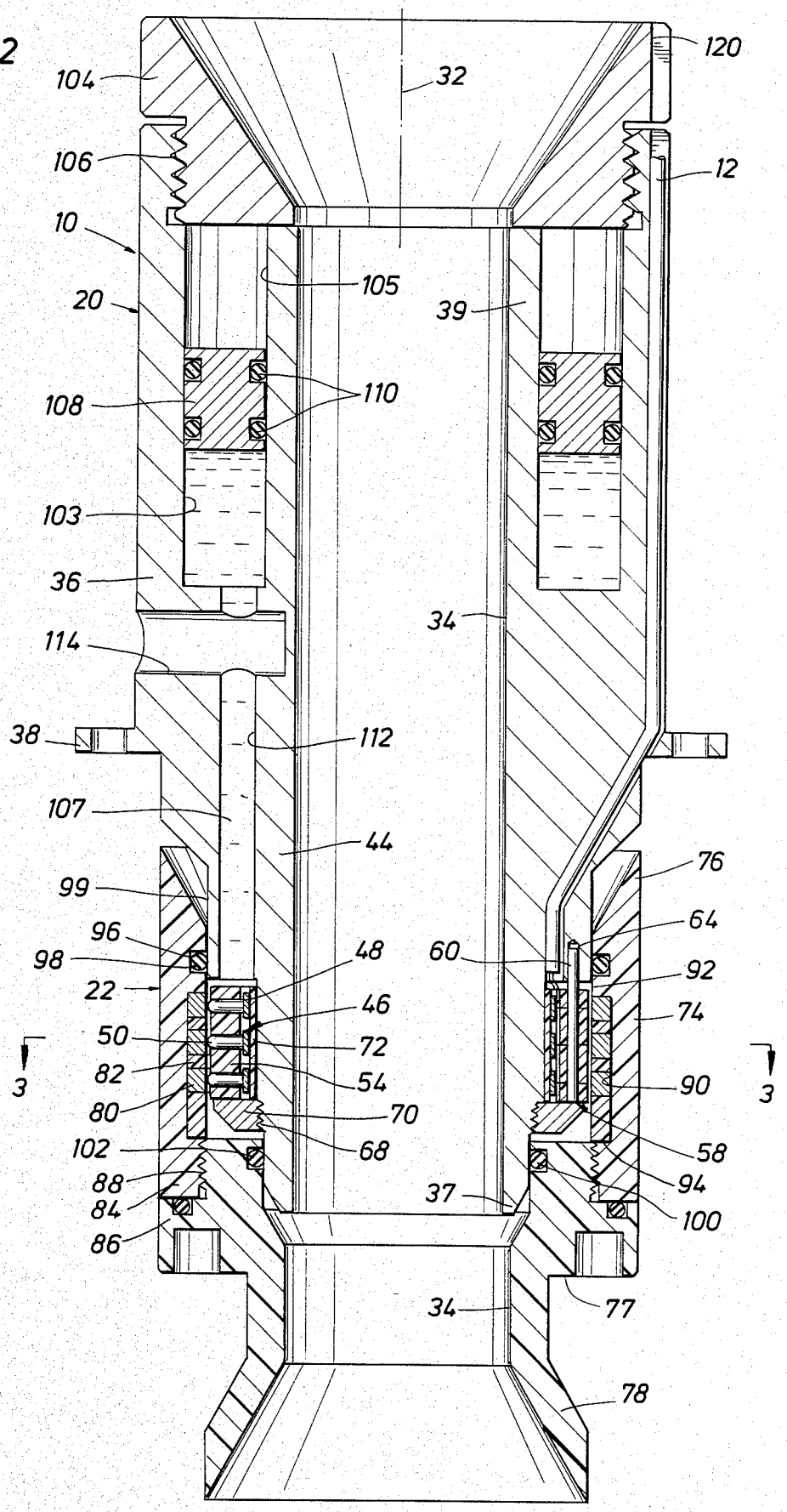
FIG. 2 shows a cross-sectional view of the assembled connector, this view generally corresponding to the elevational view of FIG. 1 and being taken along section line 2—2 of FIG. 3.

In the preferred application of the connector 10, it is necessary that fluid communication exist between the first and second elements 14, 18 of the drill string and bit assembly 19. To allow for this, the connector 10 defines a central conduit 34, preferably extending coaxially with the connector 10. This is best shown in FIG. 2. Drilling fluids, wellbore treating fluids and through drill string tools may pass through the central conduit 34. It is desirable that the connector 10 be configured so as to provide the central conduit 34 with as great a diameter as is practicable.

THE CONNECTOR FIRST PORTION

The connector first portion 20, best shown in FIG. 2, has a main body segment 36 of generally tubular configuration. The diameter of the main body segment 36 is slightly less than the internal diameter of the first element 14 so that it may be received therein. The main body segment 36 has a first end 37 extending toward the opening of the tool joint box 28 of the first element 14 and a second end 39 extending toward the interior of the first element 14. A mounting flange 38 at a midpoint on the connector first portion 20 seats against a corresponding shoulder 40 at an interior position on the first element 14. This serves to establish correct axial positioning of the connector first portion 20 relative to the first element 14. Bolts 42 pass through apertures in the mounting flange 38 and into the shoulder 40 to secure the connector first portion 20 in correct axial and radial relationship to the first element 14.

The main body segment first end 37 defines a connector pin 44. Secured to the connector pin 44 are a plurality of connector first contacts 46. These first contacts 46 are axially spaced one from the other and circumscribe the connector pin 44. In the preferred embodiment the first contacts 46 are composed of a conductive annular contact ring 48 and a plurality of pin contacts 50 projecting radially outward from the contact ring 48. The radially outermost portion of the pin contacts 50 is rounded. The connector first contacts 46 are preferably made from a beryllium-copper alloy. The first contacts 46 should be sufficiently resilient in the radial direction such that each of the pin contacts 50 and the underlying portion of the contact band 48 may be readily displaced in an upward direction.

Figure 3:
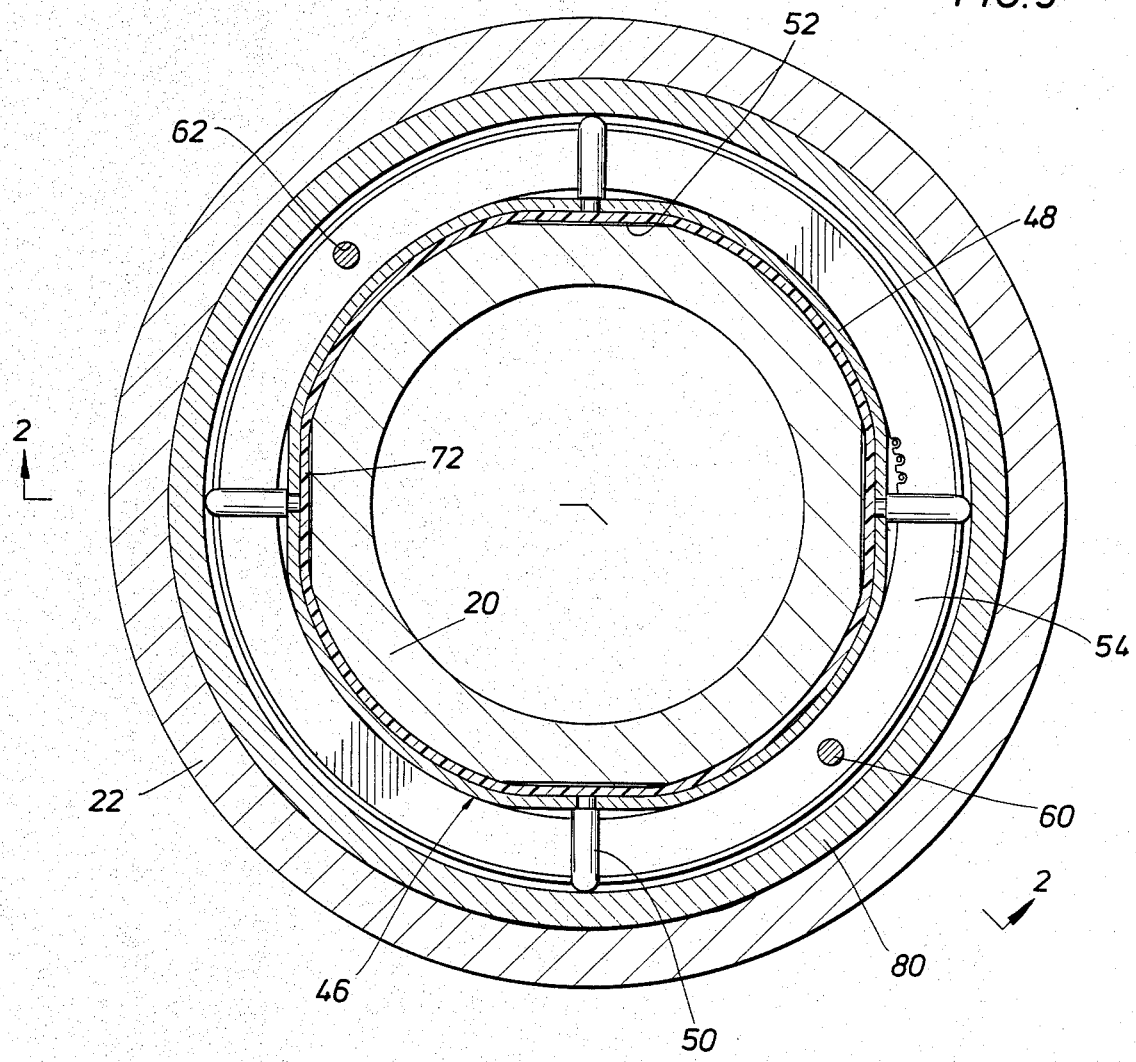
FIG. 3 shiows a radial section of the connector, taken along line 3—3 of FIG. 2.
Figure 4:
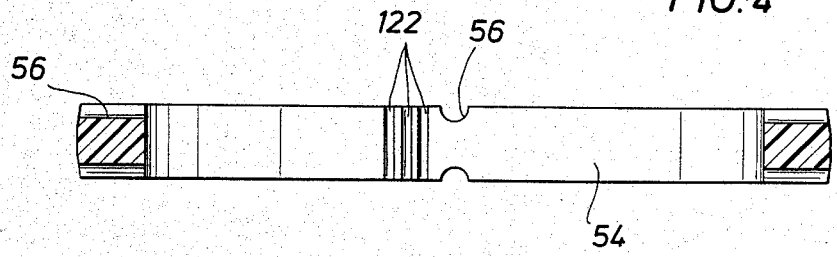
FIG. 4 shows a detail of the insulating pin spacers.

The connector pin 44 is substantially cylindrical. However, that segment of the connector pin 44 radially inward from the connector first contacts 46 has a series of flats 52 underlying the pin contacts 50. This is best shown in FIG. 3. These flats 52 allow for limited inward deflection of the pin contacts 50 in response to the application of a radially inward force.

Insulative spacers 54 surround and separate the pin contacts 50 of adjacent connector first contacts 46. These spacers 54 are annular and have an inside diameter slightly greater than the outside diameter of the contact band 48 of each connector first contact 46. Each spacer 54 seats on a corresponding portion of the underlying contact band 48 and has grooves 56 cut therein for receiving the pin contacts 50. Preferably, the outer diameter of the spacers 54 is selected such that in the uncompressed state, the pin contacts 50 project radially outward from the outer diameter of the spacers 54 by an amount at least equal to the maximum depth of each flat 52.

Means 58 are provided for preventing rotation of the connector first contacts 46 relative to the connector first portion 20. Preferably, this rotation preventing means 58 includes two dowels 60 each extending through aligned apertures 62 in the spacers 54 and being received by a corresponding aperture 64 in the connector first portion main body segment 36. The axes of these apertures 62, 64 are parallel to the tool joint longitudinal axis 32. The main body segment 36 is provided with threads 68 at a position intermediate the main body segment first end 37 and that one of the spacers 54 nearest the main body segment first end 37. A retaining nut 70 maintains the connector first contacts 46, the spacers 54 and the dowels 60 in position.

The connector first portion main body segment 36 is made of steel and the spacers 54 are made of Delrin plastic. Those skilled in the art will recognize other materials that could also be utilized. An insulating sleeve 72 is positioned intermediate the connector pin portion 44 and the connector first contacts 46. This sleeve 72 is also fashioned of Delrin. The sleeve 72 should not be so rigid as to restrain unduly the resiliency of the pin contacts 50.

THE CONNECTOR SECOND PORTION

As best shown in FIG. 2, the connector second portion 22 defines a connector box 74 terminating in a connector second portion first end 76. The connector box 74 is adapted to mate with the connector pin 44 of the connector first portion 20. Opposite the connector second portion first end 76 is a connector second portion second end 78 extending in a direction toward the center of the second element 18. The connector box 74 has an outside diameter sized to allow it to be closely received within the second element 18. Preferably, tolerances should be such as to establish a press fit securing the connector second portion 22 within the second element 18.

In the preferred embodiment, the connector 10 is adapted for use between a drill bit 18 and a drill collar 14. The second connector portion 22 is permanently attached within the drill bit 18 and is intended to be disposed of therewith upon the bit 18 becoming worn beyond further use. Epoxy or some other suitable bonding agent is used in conjunction with the press fit to secure the second connector portion 22 in position. Correct axial positioning of the connector second portion 22 is attained by the seating of a connector second portion shoulder 77 against a corresponding second element connector seating shoulder 79. The inside diameter of the connector second portion second end 78 is flared outwardly to serve as a diffuser at the interface between the connector central conduit 34 and the inside diameter of the drill string and bit assembly 19.

A plurality of annular connector second contacts 80 are positioned in axially spaced relationship from one another on the interior of the connector box portion 74. The second contacts 80 are concentric with the longitudinal axis 32 of the tool joint 24. Annular second contact insulative spacers 82 positioned intermediate adjacent second contacts 80 separate and insulate the second contacts 80 from one another. The second contacts 80 and their spacers 82 are configured and positioned such that in response to the tool joint 24 connecting the first and second elements 14. 18 being fully made up, corresponding pairs of the connector first and second contacts 46, 80 are brought into electrically conductive contact.

It is preferable to size the inside diameter of the second contacts 80 slightly smaller than the uncompressed tip to tip distance between opposite ones of the pin contacts 50 of the first contacts 46. As a result, insertion of the connector pin portion 44 into the connector box portion 74 will cause inward deflection of the pin contacts 50. This results in a biasing of the pin contacts 50 against the second contacts 80. This arrangement promotes a good electrical connection which is substantially insensitive to vibration and tolerant of manufacturing inaccuracies.

More generally, the first and second contacts 46, 80 of the connector 10 form a circuit band and circuit band contact assembly. The second contacts 80 form a plurality of circuit bands so arranged that an electrical connection can be made at any radial point thereon. As previously stated, these circuit bands are preferably annular and have a contact face which is radially symmetric about the longitudinal axis of the drill string and bit assembly. However, it is emphasized that the circuit bands need not be annular. For example, were the circuit bands to describe 90° arcs rather than the full annular configuration of the present embodiment, continuity would still be achieved since the four contact pins 50 describe a 360° circle with spacing at 90° angles.

The first contacts 46 form a plurality of circuit band contacts. The circuit band contacts have one or more points which project radially outward from the longitudinal axis of the drill string and bit assembly 19 a distance equal to or greater than the radius of the circuit band inner face. Preferably, as in the present embodiment, the circuit band contacts extend radially outward a distance greater than the inner radius of the circuit bands, and the circuit band contacts include means for allowing deflection of the circuit band contacts as they come into contact with the circuit bands. This results in the circuit band contacts being biased against the circuit bands.

The connector second portion 22 includes a first end body element 84 and a second end body element 86 which are joined at a threaded connection 88. The second contacts 80 and second contact spacers 82 are retained in an annular recess 90 defined by the first and second end body elements 84, 86. This annular recess 90 is axially bounded on one end by a reduced inside diameter section 92 of said first end body element 84 and on the other end by the thread face 94 of the second end body element 86. In assembly, the second contacts 80 and the second contact spacers 82 are placed in correctly ordered position against the reduced inside diameter section 92 of the first end body portion 84. Following this, the second end body portion 90 is threaded into the first end body portion 90 locking the second contacts 80 and second contact spacers 82 therebetween.

The reduced inside diameter section 92 of the first body element 84 defines a first annular seal groove 96 adapted for receiving a first connector seal 98. The first connector seal 98 forms a seal against a corresponding cylindrical outer face 99 of the pin portion 44 of the connector first portion 20. Similarly, a second annular seal groove 100 is provided in the second end body element 86. A second connector seal 102 is positioned in the second seal groove 100 for establishing a fluid seal at a location adjacent the first end 37 of the connector first portion 20. These two sealed interfaces serve to establish a region surrounding the first and second contacts 46, 80 which is in sealed fluid isolation from the fluids within the drill string. Preferably, the first and second connector seals 98, 102 are O-rings made of a substance selected to be compatible with the drilling fluids, borehole fluids and downhole temperatures to which the connector 10 is exposed.

DIELECTRIC FLUID INSULATING SYSTEM

The wall of the connector first portion 20 defines an annular cavity 105 in the region of the main body segment second end 39. Further, the main body segment second end 39 is adapted to receive an annular end cap 104. The end cap 104 serves as an end wall of the annular cavity 105. The annular end cap 104 is internally flared to a diameter greater than that of the connector central conduit 34. This decreases energy losses in the fluid flow from the drill string 19 to the connector 10.

The main body segment second end 39 and the end cap 104 are preferably joined by a threaded connection 106. The threaded connection 106 should have a thread fit sufficiently coarse as to allow fluid communication between the annular cavity 105 and the environment external to the connector 10. This allows fluid to enter or exit the annular cavity 105, thereby preventing the development of any significant pressure imbalances between the annular cavity 105 and the fluid within the drill string and bit assembly 19. Alternatively, a channel (not shown) can be provided placing the annular cavity 105 in direct fluid communication with the tool joint environment. This channel would preferably be positioned proximate the end cap 104.

A fluid conduit 112 extends through the main body segment 36 of the connector first portion 20 from the annular cavity 105 to the region surrounding the circuit bands and circuit band contacts. An annular piston 108 with appropriate piston seals 110 is disposed within the annular cavity 105. This annular piston 108 is sealingly moveable within said annular cavity 105. Accordingly, the annular piston 108 serves to provide a sealed, displaceable boundary between fluids within the drill string 19 and fluids within the region surrounding the contacts 46, 80. That portion of the annular cavity 105 intermediate the annular piston 108 and the contacts 46, 80, serves as a reservoir 103. It is desirable to utilize at least two annular piston seals 110 so that the seal nearest the end cap 104 serves as a scraper seal to preserve the sealing capacity of the other seal or seals 110. In place of the floating piston 108, the displaceable boundary could be a diaphragm or other yieldable element for isolating the reservoir 103 from the wellbore environment.

The connector 10 defines an enclosed, sealed volume 107 to which the interface between the contacts 46, 80 is exposed. This enclosed, sealed volume 107 includes the reservoir 103 and the fluid conduit 112. The floating piston 108 serves to maintain within a preselected range the pressure differential between the enclosed, sealed volume 107 and the fluids within the drill string 19. In response to such a pressure differential the piston 108 will move within the annular cavity 108 to enlarge or decrease, as necessary, the size of the reservoir 103 to decrease such pressure differential. Accordingly, it is advantageous to configure the piston 108 for relatively free movement within the annular cavity 105. This ensures that only a small pressure differential is maintained between the enclosed, sealed volume 107 and the fluids within the drill string 19. This is advantageous in that it minimizes the chance of leakage of the seals 98, 102 proximate the contacts 46, 80. This pressure compensation feature is especially important where there is a possibility that gas may be entrained within the dielectric fluid or trapped within the enclosed, sealed volume 107.

Figure 5:
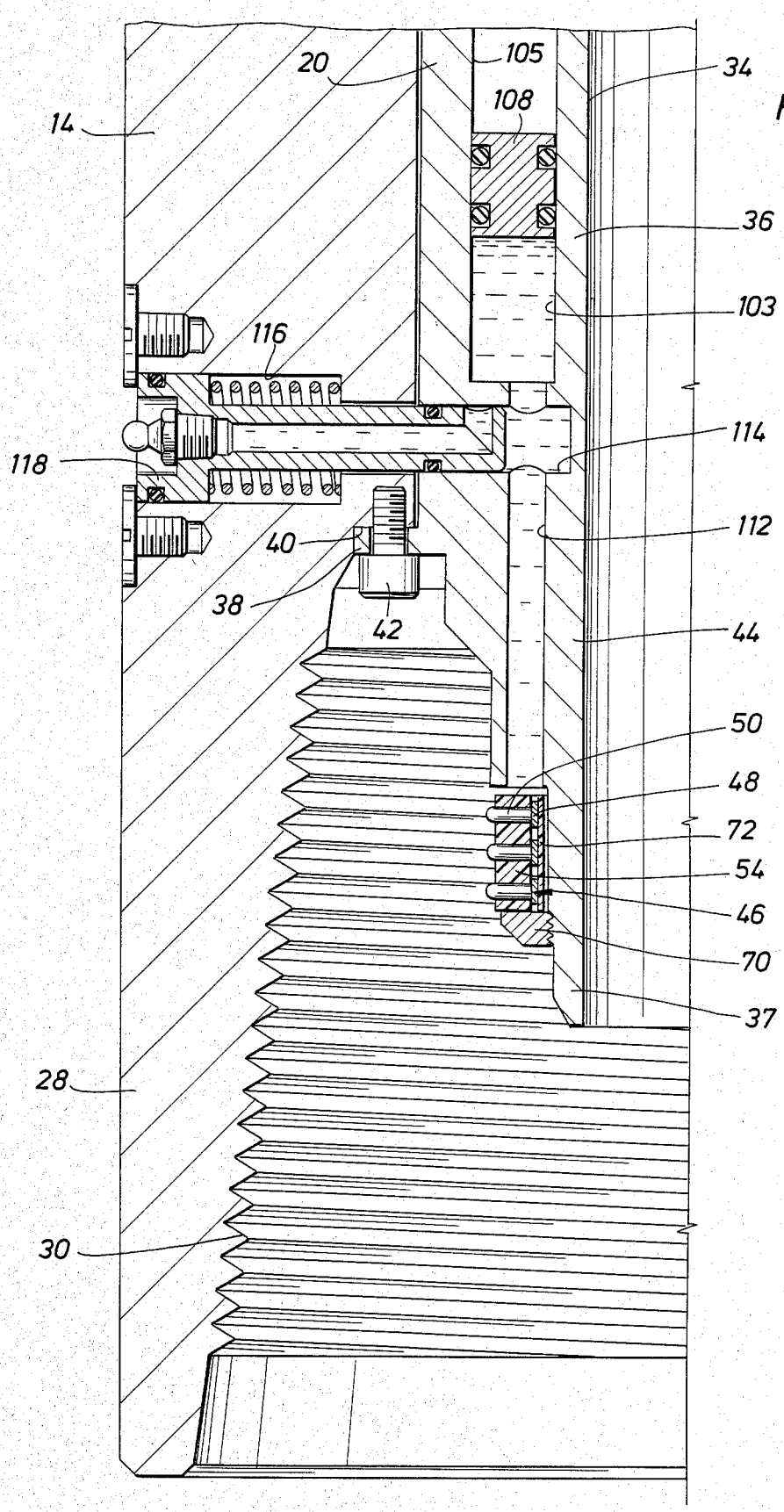
FIG. 5 shows a cross-sectional detail view of the dielectric fluid charging fitting positioned through the drill collar and into the connector first portion.

As best shown in FIG. 5, the connector first portion main body segment 36 is also provided with a radially extending charging port 114 extending from an outer wall of the connector 10 and into fluid communication with the reservoir 103. This port 114 is adapted for alignment with a corresponding aperture 116 in the tool joint 24. A fluid charging fitting 118 is disposed through the charging port 114 and the tool joint aperture 116.

Preferably, the charging fitting 118 is adapted to establish communication with the reservoir 103 only in response to the introduction of dielectric fluid through the charging fitting 118. In response to the charging fitting 118 being in the non-charging state, fluid communication from the reservoir 103 to the connector first and second contacts 46, 80 is allowed and flow through the charging port 114 is prevented.

In operation, once the tool joint 24 is made up the reservoir 103 is charged with a dielectric fluid injected through the charging fitting 108. Preferably this dielectric fluid is Dow Corning 200 fluid, manufactured by Dow Corning Corporation, of Midland, Mich. Filling the reservoir 103 with the dielectric fluid drives the annular piston 108 against the end cap 104. Subsequently, as the drill string 19 is lowered into the borehole, compensation is provided for any pressure differential between the borehole fluid and dielectric fluid. This occurs by flow of borehole fluid through the thread region of the end cap 104 into the annular recess 105. This cause displacement of the piston 108 away from the end cap 104 urging the dielectric fluid into the region surrounding the connector first and second contacts 46, 80. Toward this end, it is important that the resistance to flow of borehole fluid past the first and second connector seals 98, 102 is greater than the resistance to flow into the annular cavity 105 through the coarse threaded connection 106. Thus, a pressure differential between the enclosed, sealed volume 107 and the fluids within the drill string 19 will result in compensating displacement of the annular piston 108 rather than leakage across the sealed interfaces. Techniques for accomplishing this are familiar to those skilled in the art.

THE CONDUCTOR CONTACT CONNECTIONS

The first plurality of conductors 12 is positioned within a first conductor slot 120 extending longitudinally along the outside of the connector first portion 20. The first conductor slot 120 extends to a position proximate the connector first contacts 46. The spacers 54 are provided with notches 122 along their inside diameter. Individual wires of the first plurality of conductors 12 pass through the notches 122 to an appropriate one of the first contacts 46 to which they are soldered. The rotation preventing means 58 serves to prevent the soldered connection from being broken by relative motion between the individual conductors and the contact bands 48. The first plurality of conductors 12 is preferably potted within the conductor slot 120. This provides strain relief for the point of electrical connection and prevents the intrusion of borehole fluids into the connector 10 along the path of the first plurality of conductors 12.

The second plurality of conductors 16 is positioned within a second conductor slot (not shown) extending in a substantially longitudinal direction through the connector second portion 22. The individual wires of the second plurality of conductors 16 are each soldered to the corresponding one of the connector second contacts 80. Prevention of rotation of the connector second contacts 80 relative to the connector second portion 22 is obtained by firmly threading the connector second body portion 22 first and second elements 84, 86 together. The second conductor bundle 16 should be potted in the same manner as the first conductor bundle 12.

It will be apparent that various changes may be made in the details of the described embodiment of the connector 10 for providing electrical continuity across a threaded connection without departing from the spirit and scope of the present invention as defined in the appended claims. Further, it should be noted that there are numerous potential uses for the connector 10 in addition to that described in detail above.

We claim:

1. A connector for establishing electrical continuity between a plurality of conductors in a first element and a plurality of corresponding conductors in a second element, said first element having a box end and said second element having a pin end adapted to be threaded into said first element box end, said first and second elements defining, in the assembled condition, a longitudinal axis and a longitudinally extending, central recess adapted for receiving fluid flow therethrough, said connector comprising:

a generally annular connector box element fixedly positionable within said second element pin end, said connector box element having a plurality of circuit bands, said circit bands lying in planes perpendicular to said longitudinal axis and having a center of curvature on said longitudinal axis, said circuit bands being adapted to be connected to corresponding ones of said second element conductors;

a generally annular connector pin element fixedly positionable within said first element box end, said connector pin element having a plurality of circuit band contacts, said circuit band contacts being adapted to be connected to corresponding ones of said first element conductors, said conductor pin element being adapted to be so positioned within said first element box end and said circuit band contacts being so arranged that in response to said first and second elements being threadably connected, said circuit band contacts are biased against corresponding ones of said circuit bands;

means for establishing an enclosed, sealed volume surrounding said circuit bands and circuit band contacts, said enclosed, sealed volume being adapted to be occupied by a dielectric fluid; and means for varying the pressure of said dielectric fluid within said enclosed, sealed volume in response to pressure changes within said central recess such that the pressure differential across all sealed interfaces separating said enclosed, sealed volume from said central conduit is maintained within a preselected range.

2. The electrical continuity establishing apparatus, as set forth in claim 1, wherein said pressure varying means includes a fluid reservoir, said fluid reservoir being defined by one of said conductor box element and said conductor pin element, said reservoir being a portion of said enclosed, sealed volume, and being in pressure communication with said central recess such that increasing pressure within said central conduit urges dielectric fluid into said sealed region from said reservoir.

3. The electrical continuity establishing apparatus, as set forth in claim 2, further including a moveable physical interface separating said reservoir from fluid communication with said central recess.

4. The electrical continuity establishing apparatus, as set forth in claim 3, wherein said interface includes a piston moveable within said reservoir in response to changes in the pressure within said central conduit.

5. An electrical connector for establishing electrical continuity between a plurality of conductors in a first threaded element and a corresponding plurality of conductors in a second threaded element, said first and second elements having mating threaded ends at which said first and second elements may be threadably joined, said first and second threaded elements defining a longitudinally extending central recess adapted for receiving fluid flow therethrough, said central recess defining a longitudinal axis, said connector comprising:

a connector pin element and a connector box element, said pin and box elements each being adapted to be secured at a location radially within a corresponding one of the mating threaded ends of said first and second threaded elements;

circuit bands affixed to one of said pin element and said box element, said circuit bands lying in planes perpendicular to said longitudinal axis and having a center of curvature on said longitudinal axis;

circuit band contacts affixed to the other of said pin element and said box element, said circuit band contacts being configured and positioned so that in response to said first and second elements being threadably connected, each of said circuit band contacts is biased against a corresponding one of said circuit bands;

said connector pin and box elements being configured to define an enclosed, sealed volume in response to said first and second threaded elements being threadably connected, said sealed volume being adapted to contain a dielectric fluid, the interface between said circuit bands and circuit band contacts being located within said enclosed, sealed volume; and, a dielectric fluid reservoir in said enclosed, sealed volume, said reservoir having a displaceable boundary, movement of said displaceable boundary relative to said connector pin and box elements serving to alter the volume of said sealed region.

6. The electrical connector of claim 5 wherein said displaceable boundary sealingly separates a region of said connector in fluid communication with said central recess from said enclosed, sealed volume, pressure imbalances between said central recess and said enclosed, sealed volume being accommodated by displacement of said displaceable boundary.

7. The electrical connector of claim 5 wherein said displaceable boundary includes a piston, said piston forming a moveable boundary for said reservoir.

8. The electrical connector of claim 5 wherein said first and second threaded elements are portions of a drill string and bit assembly and wherein said central recess is defined by the inside diameter of a drill string and bit assembly.

9. The electrical connector of claim 8 further including means for introducing a supply of dielectric fluid into said enclosed, sealed volume from a position external to said drill string and bit assembly.

10. A drill string and bit assembly adapted for passing electrical signals between at least one adjacent pair of threadably connectable elements of said assembly, comprising:

a first element having a longitudinal axis extending between opposed first and second ends of said first element, and being adapted to permit fluid flow from one to the other of said first element ends;

a second element having a longitudinal axis extending between opposed first and second ends of said second element, said second element defining a conduit adapted to permit fluid flow between said second element ends, said second element first end and said first element second end having mating threads and being adapted to be threadably connected one to the other such that said first element and second element longitudinal axes are maintained in fixed colinear relationship;

a plurality of curvilinear, insulated circuit bands positioned at an interior location on one of said first and second elements and being at a spaced distance from said threads, each of said circuit bands having a center of curvature on said longitudinal axis;

a plurality of circuit band contacts affixed to the other of said first and second elements, said circuit bands and circuit band contacts being configured and positioned such that in response to said first and second elements being fully threaded together, corresponding circuit bands and circuit band contacts are in biased contact establishing a plurality of electrically conductive interfaces;

a first plurality of conductors attached to said one of said first and second elements, each one of said first plurality of conductors being in fixed electrical contact with a corresponding one of said circuit bands;

a second plurality of conductors attached to said other of said first and second elements, each one of said second plurality of conductors being in fixed electrical contact with a corresponding one of said circuit band contacts;

means for establishing a sealed region enclosing said circuit bands and circuit band contacts, said sealed region being adapted to contain a dielectric fluid and to resist intrusion of fluids flowing through said first and second elements; and, a connector first portion affixed within one of said first and second elements, said circuit band contacts being positioned within said connector first portion;

a connector second portion affixed within the other of said first and second elements, said circuit bands being positioned within said connector second portion, said first and second connector portions defining a central conduit adapted for receiving the passage of fluids therethrough, said first and second connector portions being configured and positioned such that in response to said first and second elements being threaded together, said first and second connector portions come into contact with one another in sealing relationship to establish a plurality of sealed interfaces which define said sealed region.

11. The assembly, as set forth in claim 10, further including means for supplying additional dielectric fluid to said sealed region in response to pressure increases external to said sealed region.

12. The assembly, as set forth in claim 10, further including:

a reservoir adapted for storing dielectric fluid, said reservoir being in fluid communication with said sealed region; and means for transferring dielectric fluid between said reservoir and said sealed region in response to changes in the pressure within said first and second elements to maintain a substantially balanced pressure across said sealed interfaces.

13. The assembly, as set forth in claim 10, further including a port in said drill string and bit assembly, said port being adapted for establishing fluid communication with said sealed region such that dielectric fluid can be introduced into said sealed region from a point external to said drill string and bit assembly, with said first and second elements being in the assembled condition.

14. The drill string and bit assembly as set forth in claim 10, wherein said second element is a drill bit and said first element is that segment of the drill string connected to said drill bit.

* * * * *